US006893107B2

(12) United States Patent
Kramer

(10) Patent No.: US 6,893,107 B2
(45) Date of Patent: May 17, 2005

(54) METHOD AND SYSTEM FOR VISUALIZING PRINTED FLUIDS USING INDICATOR MEDIA

(75) Inventor: Laura Kramer, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/340,176

(22) Filed: Jan. 9, 2003

(65) Prior Publication Data

US 2004/0135837 A1 Jul. 15, 2004

(51) Int. Cl.[7] ..... B41J 29/393
(52) U.S. Cl. ..... 347/19; 347/98; 700/118
(58) Field of Search ..... 347/19, 96, 98, 347/105, 15, 43, 4; 116/206; 700/118–120; 308/504; 400/74

(56) References Cited

U.S. PATENT DOCUMENTS 5,898,443 A * 4/1999 Yoshino et al. ..... 347/19
5,980,016 A * 11/1999 Nelson et al. ..... 347/19
6,270,335 B2 * 8/2001 Leyden et al. ..... 425/375
6,312,082 B1 * 11/2001 Lund et al. ..... 347/19
6,474,768 B1 11/2002 Yano et al. ..... 347/19
6,474,770 B1 11/2002 Endo ..... 347/19
6,476,926 B1 11/2002 Yano et al. ..... 358/1.14
6,572,213 B2 * 6/2003 Valero ..... 347/19

FOREIGN PATENT DOCUMENTS

JP 06057186 * 3/1994 ..... C09D/11/00
JP 08015249 * 1/1996 ..... G01N/31/22

* cited by examiner

*Primary Examiner*—Lamson Nguyen
*Assistant Examiner*—Blaise Mouttet

(57) ABSTRACT

A method for detecting a print fluid includes printing the print fluid from a printing device onto an indicating medium; and producing a visible contrast between a printed area of the indicating medium and a non-printed area of the indicating medium that is formed by a reaction of the indicating medium to the print fluid.

16 Claims, 3 Drawing Sheets

METHOD AND SYSTEM FOR VISUALIZING PRINTED FLUIDS USING INDICATOR MEDIA

BACKGROUND

Inkjet technology is now used in a wide variety of applications. Originally, inkjet techniques were developed in printers that selectively eject drops of ink or other marking fluid onto a printing medium to produce a hardcopy document from electronic data. More recently, inkjet techniques have been used in such diverse applications as fuel injectors and three-dimensional freeform fabrication systems.

As used herein and in the appended claims, the term "printing device" will be used to refer to any device for whatever application that ejects a fluid using inkjet printing techniques, including, thermal and piezo-electric inkjet printing techniques.

At the manufacturing level, inkjet printing devices for virtually any application are subjected to various tests before being released for sale to the consumer. These tests determine whether the inkjet nozzles are functional and whether the print head is properly aligned with respect to other print heads used in the system.

Further, consumers must maintain their printers by periodically performing maintenance tests to ensure that the print nozzles are functional, and that the print head is properly aligned. These tests are similar or identical to tests performed by the manufacturer.

A particular problem associated with such tests is the need to test not only the flow of colored fluids, but also the flow of clear fluids such as binders, build materials, fuels, etc. It is difficult or impossible to see such clear fluids on paper. Consequently, it is not very effective to test the print head by attempting to deposit fluid on a sheet of paper. However, this is the conventional method of testing the operation of an inkjet print head.

In some alignment tests, where the print head uses a clear fluid, black ink is used so that operation of the print head can be observed. Then the black ink is purged from the print head and the print head is supplied with the desired clear fluid. However, if the print head has to be removed and reinstalled after purging the black ink, there is no method for realigning the print head that is now using a clear fluid.

Currently there are several methods that are used to visualize clear or light colored fluids after ejection so that the correct operation of the print head can be observed and verified. One very popular method involves the addition of an ultraviolet (UV) indicator to the ink or fluid being ejected. After the test cycle is finished, the clear or light colored fluid can be viewed when UV light is emitted onto the pattern of ejected fluid. However, the UV indicator is an expensive additive. Moreover, it is not practical or cost effective for every printer technician or owner to purchase a UV light and to be subject to the complexity of adding UV indicator to the print fluid or to purchase print fluid that includes UV indicator. Some printers are equipped with a UV light emitter, but this adds to the expense of the printer.

Another method that is currently used for visualizing clear or light colored fluid involves viewing clear fixer on a transparent or glossy medium. This method is also commonly used for viewing clear binder. Such a method is used somewhat successfully in printer alignment tests, but is not considered adequate for nozzle health tests. In either case, it is still difficult to visualize transparent or light colored fluids on a clear or glossy background.

SUMMARY

In one of many possible embodiments, a method for detecting a print fluid is provided that includes printing the print fluid from a printing device onto an indicating medium and producing a visible contrast between a printed area of the indicating medium and a non-printed area of the indicating medium that is formed by a reaction of the indicating medium to the print fluid.

In another embodiment, a medium for detecting a print fluid is provided by a sheet of print medium onto which a printing device ejects the print fluid, the medium having an indicator, which reacts with the print fluid ejected by the printing device to cause a visible contrast between a printed area of the medium and a non-printed area of the medium.

In another embodiment, a system for detecting a print fluid includes a printing device for ejecting the print fluid and a sheet of indicating medium which comprises an indicator which, when contacted during printing with the print fluid, causes a visible contrast between a printed area of the medium and a non-printed area of the medium.

In another embodiment, a method for assessing the nozzle health for a printing device includes ejecting at least one print fluid from a set of printing device nozzles onto an indicating medium, and determining whether the individual printing device nozzles are functional based on a pattern of contrast between a printed area of the indicating medium and a non-printed area of the indicating medium, wherein the contrast is visible due to a reaction between the indicating medium and the print fluid.

In another embodiment, a method for assessing whether a print head for a printing device is properly aligned includes ejecting at least one print fluid from a set of printing device nozzles of the print head onto an indicating medium, and determining whether the print head is properly aligned based on a pattern of contrast between a printed area of the indicating medium and a non-printed area of the indicating medium, wherein the contrast is visible due to a reaction between the indicating medium and the print fluid.

Additional advantages and novel features of the embodiments will be set forth in the description which follows or may be learned by those skilled in the art through reading these materials or practicing the described embodiments. The advantages of the described embodiments may be achieved through the means recited in the attached claims.

DETAILED DESCRIPTION

A method and technique are described herein for detecting printed fluids that are difficult or impossible to view with the naked eye. The method can be performed without the need for expensive detecting devices or complex chemicals as additives to the print fluid. Further, the method is simple and user friendly, and satisfies the need for a consumer-ready process of little complexity for detecting printed fluids that are difficult to see.

Figure 1:
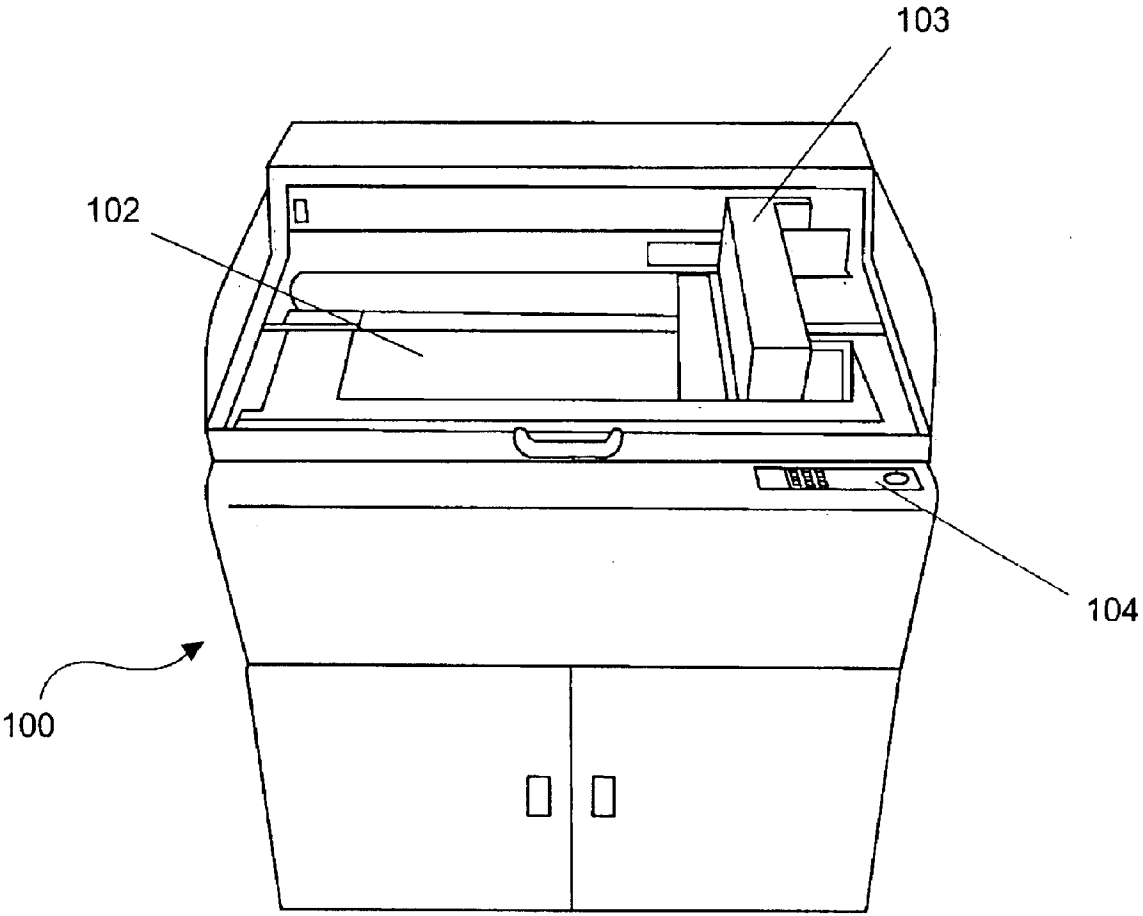
FIG. 1 illustrates a freeform fabrication system in which printing devices are used.

FIG. 1 illustrates one solid freeform fabrication system that uses printing devices. In the solid freeform fabrication system (100) of FIG. 1, a powdery material is used to form each individual layer of the desired product. To do this, a measured quantity of powder is first provided from a supply chamber. A roller, preferably incorporated into a moving stage (103), then distributes and compresses the powder at the top of a fabrication chamber (102) to a desired thickness.

The moving stage (103) also preferably includes a print head that deposits a binder selectively onto the powder in the fabrication chamber (102) in a two dimensional pattern. This two dimensional pattern is a cross section of the desired product. The binder may be colored with ink, toner, or other materials to provide a desired color or color pattern for this particular cross section of the desired product. In some embodiments, a clear binder is ejected from one set of nozzles, while ink or colored binder is ejected from another set of nozzles. In a preferred embodiment, a different color of ink or colored binder can be ejected from multiple sets of ink nozzles.

The powder becomes bonded in the areas where the binder is deposited, thereby forming a layer of the desired product. The process is repeated with a new layer of powder being applied over the top of the previous layer in the fabrication chamber (102). The next cross section of the desired product is then printed with binder into the new powder layer. The binder also serves to bind the adjacent or successive layers of the desired product together.

This process continues until the entire object is formed within the powder bed in the fabrication chamber (102). The extra powder that is not bonded by the binder is brushed away leaving the object. A user interface or control panel (104) is provided to allow the user to control the fabrication process.

In other solid freeform fabrication systems, the nozzles do not eject binder into a build material, but rather selectively eject the build material, such as a polymer or photo-prepolymer. This ejected build material may be clear and colorless, with ink being mixed with it or ejected over it to color the object being formed.

Figure 2:
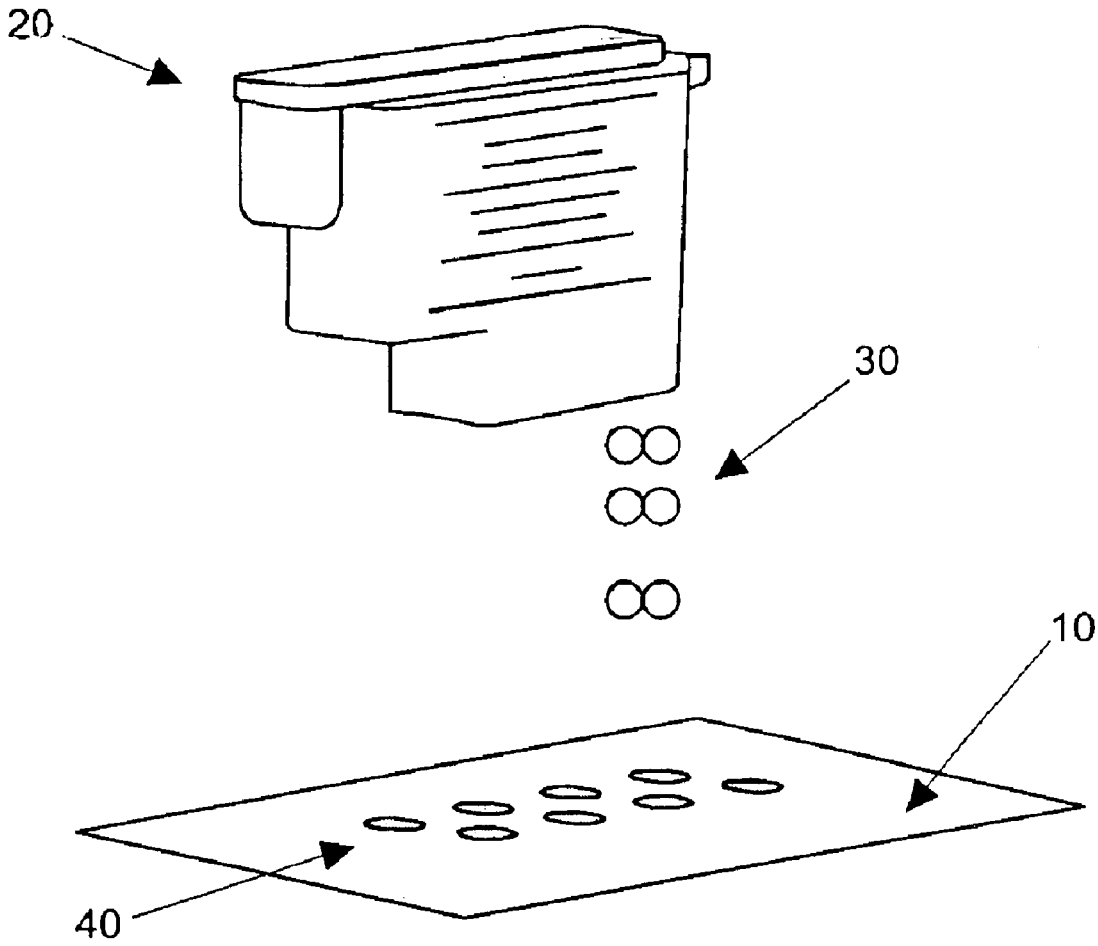
FIG. 2 shows a system for detecting a printed fluid according to an embodiment of the present invention. The illustrated embodiment is merely an example of the present invention and does not limit the scope of the invention.

An embodiment of the present invention which incorporates the solid freeform fabrication system is shown in FIG. 2, in which print fluid (30) is ejected from the print head (20) of a printer onto an indicating medium (10), such as paper. The indicating medium (10) includes an indicator compound. The type of indicator compound used can be, for example, a pH detecting compound that is embedded in or coated onto the indicating medium (10).

The print fluid (30) is a transparent or light colored fluid. Transparent fluids include, for example, binders, build materials, fuels, etc. Examples of light colored fluids include inks, colorants, build materials and marking fluids that are, for example, yellow colored compounds, light blues, light pinks, mixtures of such colors, and other very faint color hues that can be very difficult to see absent the use of an indicator compound as described herein.

Once the print fluid (30) is printed onto the indicating medium, the indicator compound that is embedded in or coated onto the indicating medium (10) reacts to the deposition of the print fluid (30) and causes a visible contrast between a printed area (40) of the indicating medium (10) and the remaining portion of the medium which is not printed with the print fluid (30). The contrast is most preferably evident when a person views the indicating medium using the naked eye so that no extra detecting chemicals, light, or devices are needed to detect the presence of printed fluid in the printed area (40).

When a pH detecting compound or composition is to be used as the indicator compound, the compound or composition should be one that changes appearance in the presence of base if the printed fluid is basic (i.e., pH>7). Further, the pH detecting compound or composition should be one that changes appearance in the presence of an acid if the printed fluid is acidic (i.e., pH<7). The pH detecting compound should also be one that changes appearance in the presence of a neutral solution if the printed fluid is neutral (i.e., pH 6–8). In many situations, the binder or fixer fluid is slightly acidic, so a suitable indicating medium would be a pH 1 to 6 detecting sheet that produces a brilliant contrast compared to the background of unprinted area.

As an example of the type of paper that can be used as a printed fluid detector in a kit or in a method for detecting printed fluid, pHydrion Brilliant™ 1–6 pH paper, produced by Microessential Laboratories, was used in a freeform fabrication system when performing both nozzle health diagnostic and print head alignment assessment procedures. A clear binder for the fabrication system was printed onto the pH 1–6 paper, which is typically reddish tinted as received and when contacted with very acidic fluid (i.e. pH 1). This paper changes color to a greenish tint when contacted with less acidic, neutral or basic fluid (i.e. pH>6).

When performing the nozzle health diagnostic, the clear binder was clearly evident in the printed areas of the pH 1–6 paper. Further, when performing a print head alignment assessment, the clear binder was clearly evident, as well as yellow, magenta, and cyan inks that were printed on the pH 1–6 paper.

Although the preceding example shows how clear binder and colored fluids can be viewed, the utility of an indicator compound or composition is clearly not limited to viewing those liquids discussed thus far. For example, other printing liquids that are invisible or difficult to see, such as a fixer fluid used in various types of printers can be clearly viewed using a paper that is sized and adapted to be used in a particular system of interest that employs inkjet printing technology.

Figure 3:
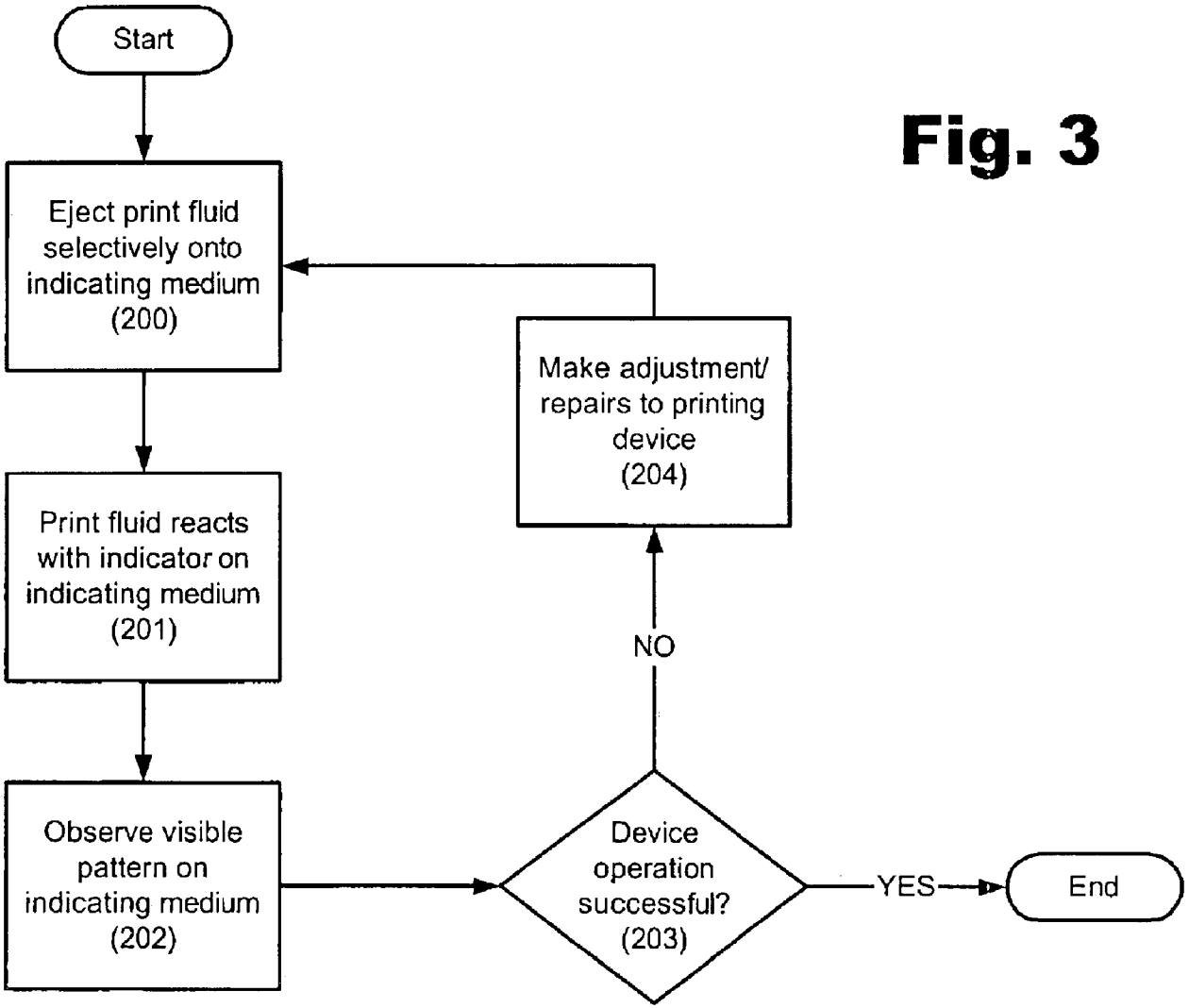
FIG. 3 is a flowchart illustrating a method using a system, for example the system of FIG. 2, according to an embodiment of the present invention.

FIG. 3 is a flowchart illustrating a method using a system, for example the system of FIG. 2. As shown in FIG. 3, the print fluid is ejected selectively onto the indicating medium (step 200). For example, the print fluid may be ejected in a precise test pattern which can then be examined to verify the appropriate operation of the printing device.

Next, the print fluid reacts with the indicator that is on or in the indicating medium (step 201). Absent this reaction, the print fluid is clear or light and difficult to see on a print medium.

Following the reaction, the now-visible pattern of the print fluid on the indicating medium can be observed (step 202). This step may be performed, for example, by a printing device manufacturer, repair technician or owner.

As indicated, by observing the visible pattern produced on the indicating medium by the print fluid, the successful operation of the printing device can be verified (determination 203). If the printing device is operating properly, no further action need by taken.

However, if the printing device is not operating properly based on the print pattern now visible on the indicating medium, adjustments or repairs to the printing device can be made (step 204). The pattern on the indicating medium may give clues as to the exact nature of the problem with the printing device that should be rectified. For example, the pattern on the indicating medium may demonstrate that the printing device is not properly aligned. Missing sections of the pattern on the indicating medium will demonstrate nozzles of the printing device that are non-functional. If the printing device is in need of adjustments or repairs, after those adjustments or repairs are made, the process may be repeated to verify that the printing device is now functioning properly following the corrective action taken. A test pattern of print fluid is again ejected onto a, preferably, fresh sheet of indicating medium (step 200) and the process is repeated.

Using the method and indicating medium described herein, a printing device in any of a wide variety of applications can be tested for proper operation even though that printing device uses a clear or light printing fluid that is not readily visible on a traditional print medium. Consequently, manufacture, testing and maintenance of such printing device is made much easier and cost effective.

The preceding description has been presented only to illustrate and describe embodiments of the present invention. This description is not intended to be exhaustive or to limit the invention to any precise form disclosed. Many modifications and variations are possible in light of the above teaching. It is intended that the scope of the invention be defined by the following claims.

What is claimed is:

1. A method for detecting a print fluid to assess proper operation of a printing device, which comprises:

selectively printing said print fluid from a printing device onto an indicating medium in a predetermined pattern;

producing said predetermined pattern on said indicating medium with a visible contrast between a printed area of said indicating medium and a non-printed area of said indicating medium that results from a reaction of the indicating medium to said print fluid; and visually inspecting said pattern to assess operation of said printing device, said predetermined pattern being configured to demonstrate whether said printing device is operating properly:

wherein said step of visually inspecting is performed by a human.

2. A method according to claim 1, wherein said print fluid is clear before being combined with said indicating medium.

3. A method according to claim 1, wherein said print fluid is a binder.

4. A method according to claim 1, wherein said indicating medium reacts in the presence of said print fluid due to a pH value of said print fluid.

5. A method according to claim 1, wherein said printing comprises selectively ejecting said print fluid from an inkjet print head of said printing device.

6. A method according to claim 1, wherein said print fluid is colored before being combined with said indicating medium.

7. The method of claim 1, wherein said inspecting is performed to assess proper operation of nozzles of said printing device.

8. The method of claim 1, wherein said inspecting is performed to assess a proper alignment of a print head in said printing device.

9. A method for assessing proper operation of a printing device in a freeform fabrication system, said method comprising:

placing an indicating medium in a fabrication chamber of said freeform fabrication system;

selectively ejecting a print fluid from said printing device of said freeform fabrication system onto said indicating medium;

producing a corresponding pattern on said indicating medium having a visible contrast between a printed area of said indicating medium and a non-printed area of said indicating medium that results from a chemical reaction of the indicating medium to said print fluid; and visually inspecting said pattern to assess operation of said printing device of said freeform fabrication system.

10. A method of claim 9, wherein said print fluid is clear before being combined with said indicating medium.

11. A method of claim 9, wherein said print fluid is a binder.

12. A method of claim 9, wherein said indicating medium reacts in the presence of said print fluid due to a pH value of said print fluid.

13. A method of claim 9, wherein said print fluid is colored before being combined with said indicating medium.

14. The method of claim 9, wherein said step of visually inspecting is performed by a human operating of said free-from fabrication system.

15. The method of claim 9, wherein said inspecting is performed to assess proper operation of nozzles of said printing device.

16. The method of claim 9, wherein said inspecting is performed to assess a proper alignment of a print head in said printing device.

* * * * *

UNITED STATES PATENT AND TRADEMARK OFFICE

CERTIFICATE OF CORRECTION

PATENT NO. : 6,893,107 B2
DATED : May 17, 2005
INVENTOR(S) : Kramer

It is certified that error appears in the above-identified patent and that said Letters Patent is hereby corrected as shown below:

Column 6,
Line 41, delete “free-from” and insert -- free-form --.

Signed and Sealed this

Third Day of January, 2006

JON W. DUDAS
*Director of the United States Patent and Trademark Office*